US009466255B2

(12) United States Patent
Park et al.

(10) Patent No.: US 9,466,255 B2
(45) Date of Patent: Oct. 11, 2016

(54) DISPLAY APPARATUS AND METHOD OF DRIVING THE SAME

(75) Inventors: Dong-Won Park, Hwaseong-si (KR); Jae Sung Bae, Suwon-si (KR); Bonghyun You, Yongin-si (KR); Kyung-Hoon Kim, Uiwang-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 329 days.

(21) Appl. No.: 13/489,980

(22) Filed: Jun. 6, 2012

(65) Prior Publication Data

US 2013/0222216 A1 Aug. 29, 2013

(30) Foreign Application Priority Data

Feb. 28, 2012 (KR) ..... 10-2012-0020541

(51) Int. Cl.

*G09G 3/20* (2006.01)
*G09G 3/30* (2006.01)
*G09G 3/36* (2006.01)

(52) U.S. Cl.

CPC ..... *G09G 3/3688* (2013.01); *G09G 3/3614* (2013.01); *G09G 2310/0297* (2013.01); *G09G 2320/0247* (2013.01); *G09G 2330/021* (2013.01)

(58) Field of Classification Search

CPC ..... G09G 3/20; G09G 3/30; G09G 3/36
USPC ..... 345/204, 55
See application file for complete search history.

(56) References Cited

U.S. PATENT DOCUMENTS

| | | | | |
|---|---|---|---|---|
| 5,886,679 | A * | 3/1999 | Matsuda et al. | 345/96 |
| 7,084,844 | B2 | 8/2006 | Yeo et al. | |
| 7,265,744 | B2 * | 9/2007 | Lee et al. | 345/103 |
| 7,420,533 | B2 * | 9/2008 | Yun | 345/96 |
| 7,477,224 | B2 * | 1/2009 | Song et al. | 345/96 |
| 7,746,334 | B2 * | 6/2010 | Lee et al. | 345/209 |
| 7,880,716 | B2 | 2/2011 | Tanaka et al. | |
| 8,344,987 | B2 * | 1/2013 | Jeoung et al. | 345/98 |
| 8,384,708 | B2 * | 2/2013 | Moon | 345/214 |
| 8,427,461 | B2 * | 4/2013 | Lin, Jr. | 345/205 |
| 8,587,504 | B2 * | 11/2013 | Joo | 345/90 |
| 2003/0151584 | A1 * | 8/2003 | Song et al. | 345/100 |
| 2004/0119672 | A1 * | 6/2004 | Lee et al. | 345/87 |
| 2007/0080914 | A1 * | 4/2007 | Sun et al. | 345/88 |

(Continued)

FOREIGN PATENT DOCUMENTS

| | | | |
|---|---|---|---|
| JP | 4079473 | B2 | 2/2008 |
| KR | 1020030083310 | A | 10/2003 |

(Continued)

*Primary Examiner* — Kumar Patel
*Assistant Examiner* — Afroza Chowdhury
(74) *Attorney, Agent, or Firm* — Cantor Colburn LLP

(57) ABSTRACT

A display apparatus includes a first pixel, a second pixel, a first selector, and a second selector. The first pixel includes first sub-pixels connected to a first gate line and respectively connected to corresponding data lines included in a first data line group and the second pixel includes second sub-pixels connected to a second gate line adjacent to the first gate line and respectively connected to corresponding data lines, one of which is included in a second data line group different from the first data line group. The first selector applies first data signals to one of odd-numbered data lines, and the second selector applies second data signals having a different polarity from the second data signals to one of even-numbered data lines.

21 Claims, 10 Drawing Sheets

(56) References Cited

U.S. PATENT DOCUMENTS

| | | | | |
|---|---|---|---|---|
| 2008/0278466 | A1* | 11/2008 | Joo | 345/205 |
| 2008/0284708 | A1* | 11/2008 | Oke et al. | 345/96 |
| 2009/0128463 | A1* | 5/2009 | Sugimoto et al. | 345/84 |
| 2010/0110058 | A1* | 5/2010 | Moh et al. | 345/211 |
| 2010/0156776 | A1 | 6/2010 | Jeoung et al. | |
| 2010/0231577 | A1 | 9/2010 | Kim et al. | |
| 2012/0194488 | A1 | 8/2012 | Park | |
| 2013/0027439 | A1* | 1/2013 | Kim et al. | 345/690 |
| 2013/0135267 | A1* | 5/2013 | Jeong et al. | 345/204 |

FOREIGN PATENT DOCUMENTS

| | | | |
|---|---|---|---|
| KR | 1020080079948 | A | 9/2008 |
| KR | 1020100073441 | A | 7/2010 |
| KR | 1020110067227 | A | 6/2011 |
| KR | 1020110072290 | A | 6/2011 |
| KR | 20120088930 | A | 8/2012 |

* cited by examiner

DISPLAY APPARATUS AND METHOD OF DRIVING THE SAME

This application claims priority to Korean Patent Application No. 10-2012-0020541, filed on Feb. 28, 2012, and all the benefits accruing therefrom under 35 U.S.C. §119, the content of which in its entirety is herein incorporated by reference.

BACKGROUND

1. Field

The disclosure relates to a display apparatus. More particularly, the disclosure relates to a display apparatus capable of improving display quality and a method of driving the same.

2. Description of the Related Art

In recent, various driving methods, such as, for example, a frame inversion driving method, a column inversion driving method, and a dot inversion driving method are applied to a display apparatus. The frame inversion, column inversion, and dot inversion driving methods invert a polarity of a data signal with respect to a reference voltage per frame, row or column, and pixel, respectively. The frame inversion, column inversion, and dot inversion driving methods are applied to not only a liquid crystal display device but also an organic light emitting display device.

Among the frame inversion, column inversion, and dot inversion driving methods, the dot inversion driving method is very effective in removing flicker. However, the dot inversion driving method causes an increase in power consumption.

SUMMARY

The disclosure provides a display apparatus and a display apparatus driving method capable of improving display quality by using polarity arrangement of data signals.

Exemplary embodiments of the invention provide a display apparatus including a plurality of data lines, a plurality of gate lines, a first pixel, a second pixel, a first selector, and a second selector. The plurality of the data lines extend in a first direction and are arranged in a second direction crossing the first direction. The plurality of the gate lines extend in the second direction, are arranged in the first direction, and are electrically insulated from the plurality of the data lines.

The first pixel includes a plurality of first sub-pixels. The plurality of the first sub-pixels are connected to a first gate line of the plurality of the gate lines and respectively connected to corresponding data lines included in a first data line group among the plurality of the data lines.

The second pixel includes a plurality of second sub-pixels. The second sub-pixels are connected to a second gate line adjacent to the first gate line and respectively connected to corresponding data lines, one of which is included in a second data line group among the plurality of the data lines, the second data line group being different from the first data line group.

The first selector selectively applies first data signals to one of odd-numbered data lines included in the first and second data line groups in response to a first control signal.

The second selector selectively applies a second data signals to one of even-numbered data lines included in the first and second data line groups in response to a second control signal, the first data signals having a different polarity from the second data signals.

In an exemplary embodiment, each of the first data line group and the second data line group includes consecutive first to i-th data lines, and the first data line group and the second data line group are alternate with each other, and the i is a natural number larger than 2.

In an exemplary embodiment, the plurality of the first sub-pixels of the first pixel are connected to first to i-th data lines of the first data line group and the plurality of the second sub-pixels of the second pixel are connected to second to i-th data lines of the first data line group and to a first data line of the second data line group, the second data line group adjacent to the first data line group.

Exemplary embodiments of the invention provide a display apparatus including a plurality of data lines, a first gate line and a second gate, a first pixel, a second pixel, first selectors and second selectors. The plurality of the data lines are divided into a first data line group and a second data line group alternate with the first data line group, each of the first and second data line groups comprising first to i-th consecutive data lines, wherein i is a natural number larger than 2.

The first gate line and the second gate line alternate with each other to cross corresponding data lines.

The first pixel includes an i number of first sub-pixels connected to the first gate line and respectively connected to the i number of data lines of the first data line group.

The second pixel includes an i number of second sub-pixels connected to the second gate line and respectively connected to second to i-th data lines of the first data line group and a first data line of the second data line group.

The first selectors selectively apply first data signals to odd-numbered data lines of the data lines in accordance with a first control signal.

The second selectors selectively apply second data signals to even-numbered data lines of the data lines in accordance with a second control signal, the first data signals having a different polarity from the second data signals.

BRIEF DESCRIPTION OF THE DRAWINGS

The above and other advantages of the invention will become readily apparent by reference to the following detailed description when considered in conjunction with the accompanying drawings wherein.

DETAILED DESCRIPTION

Figure 1:
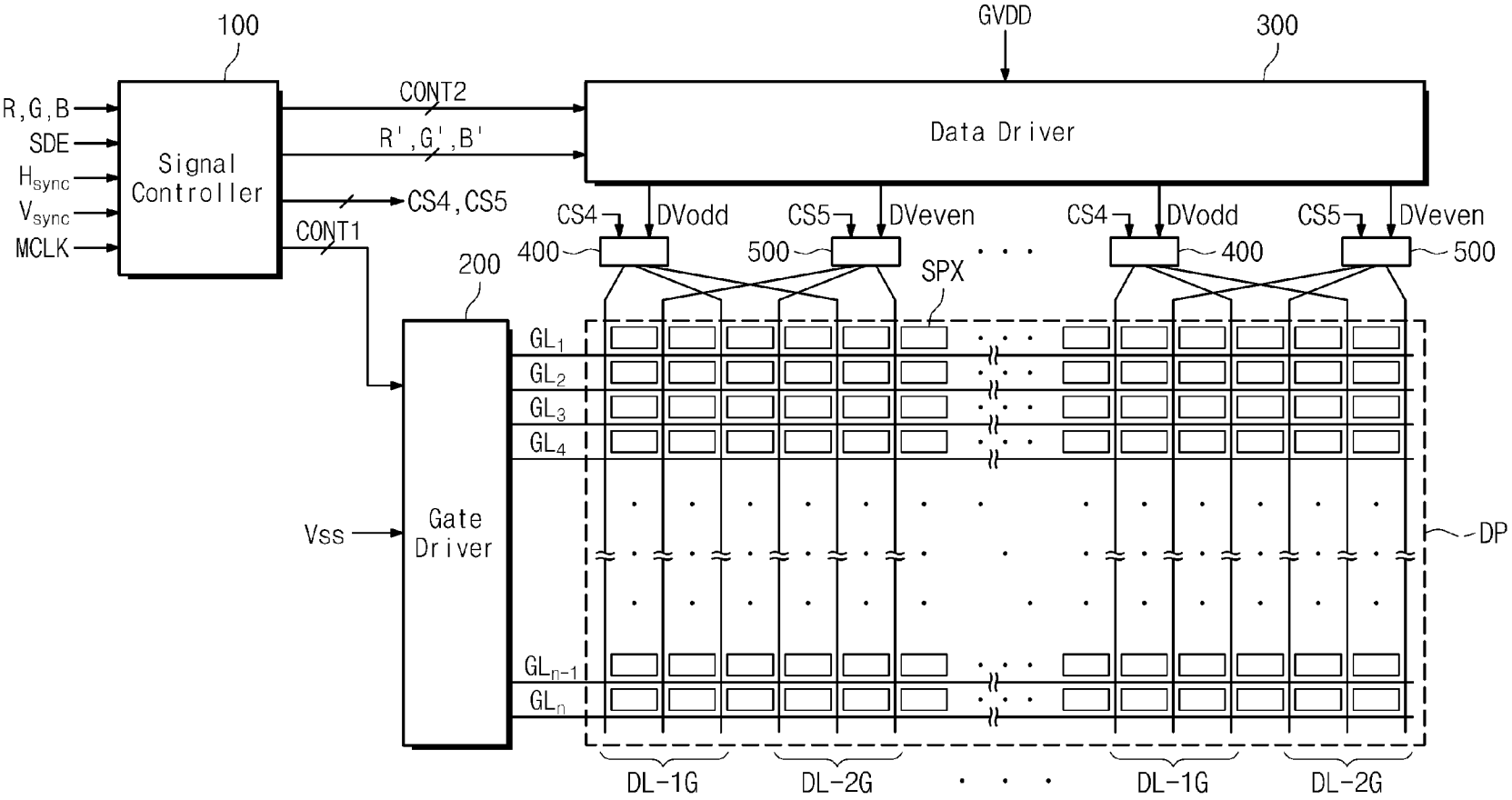
FIG. 1 is a block diagram showing an exemplary embodiment of a display apparatus according to of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Figure 2A:
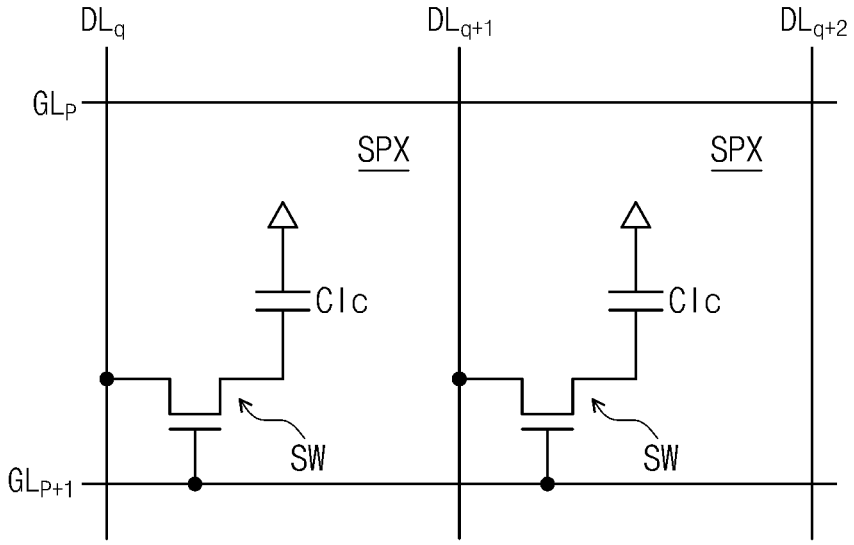
FIG. 2A is a circuit diagram showing an exemplary embodiment of a sub-pixel shown in FIG. 1.

FIG. 1 is a block diagram showing an exemplary embodiment of a display apparatus according to the invention. FIG. 2A is a circuit diagram showing an exemplary embodiment of a sub-pixel shown in FIG. 1, FIG. 2B is a plan view showing the sub-pixel shown in FIG. 2A, and FIG. 2C is a cross-sectional view taken along line I-I' shown in FIG. 2B.

Referring to FIG. 1, the display apparatus includes a display panel DP, a signal controller 100, a gate driver 200, a data driver 300, a first selector 400, and a second selector 500.

The display panel DP displays an image. The display panel DP includes a plurality of data lines which include a first data line group DL-1G or a second data line group DL-2G, the plurality of the data lines extending in a first direction (e.g., a vertical direction), a plurality of gate lines $GL_1$ to $GL_n$ extending in a second direction (e.g., a horizontal direction), and a plurality of sub-pixels SPX. Hereinafter, 'DL-1G and DL-2G' are used to collectively refer to the plurality of the data lines. The gate lines $GL_1$ to $GL_n$ are insulated from the data lines DL-1G and DL-2G. Each of the sub-pixels SPX is connected to a corresponding one of the data lines DL-1G and DL-2G and a corresponding one of the gate lines $GL_1$ to $GL_n$.

Figure 2B:
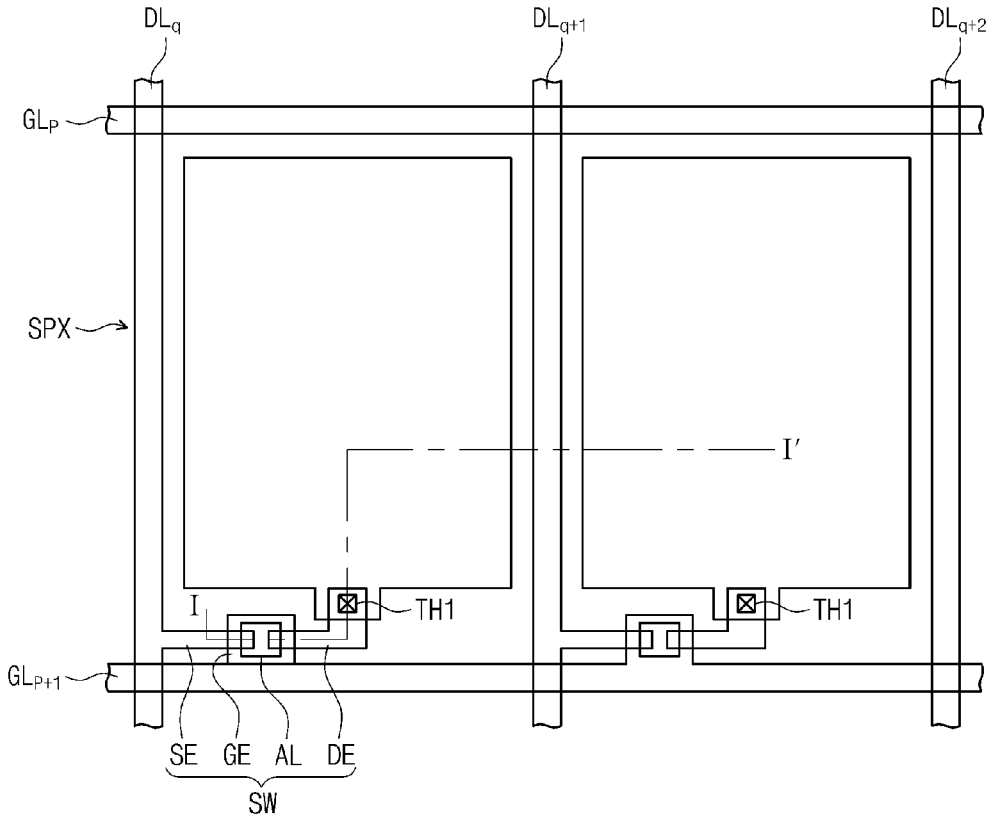
FIG. 2B is a plan view of the sub-pixel shown in FIG. 2A.
Figure 2C:
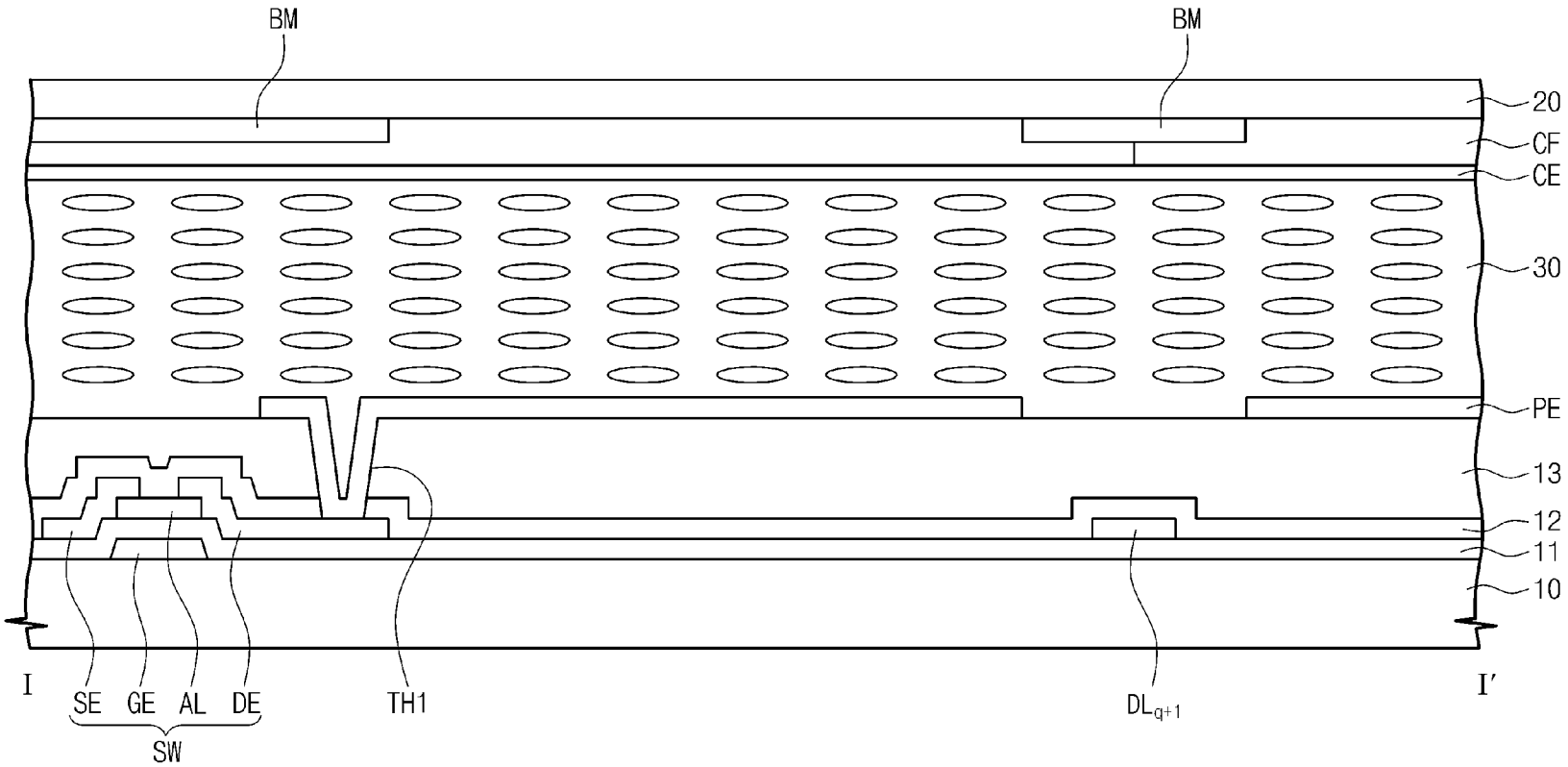
FIG. 2C is a cross-sectional view taken along line I-I' shown in FIG. 2B.

FIGS. 2A to 2C show two sub-pixels of the sub-pixels SPX shown in FIG. 1. The two sub-pixels SPX have the same structure and function, and thus one sub-pixel SPX at a left position will be described in detail with reference to FIGS. 2A to 2C. In addition, a liquid crystal display panel will be described as an example of the display panel.

Referring to FIG. 2A, the sub-pixel SPX includes a switching device SW and a liquid crystal capacitor Clc. The switching device SW outputs a data signal to the liquid crystal capacitor Clc in response to a gate signal. The liquid crystal capacitor Clc is charged with a voltage corresponding to a voltage difference between the data signal and a common voltage.

As shown in FIGS. 2B and 2C, the switching device SW is disposed on a first substrate 10. The switching device SW may be a thin film transistor including a gate electrode GE, a source electrode SE, a drain electrode DE, and an active layer AL.

The gate electrode GE is branched from a gate line $GL_{P+1}$. That is, the gate electrode GE is protruded from the gate line $GL_{P+1}$ when viewed from a side.

A gate insulating layer 11 that covers the gate line $GL_{P+1}$ and the gate electrode GE are disposed on the first substrate 10. The active layer AL is disposed on the gate electrode GE while the gate insulating layer 11 is interposed therebetween. Data lines $DL_q$, $DL_{q+1}$, and $DL_{q+2}$ are disposed on the gate insulating layer 11.

The source electrode SE is branched from one of the data lines $DL_q$, $DL_{q+1}$, and $DL_{q+2}$. The source electrode SE is partially overlapped with the gate electrode GE and the active layer AL when viewed in cross section. The drain electrode DE is spaced apart from the source electrode SE when viewed in cross section.

A protective layer 12 and a planarization layer 13 are disposed on the first substrate 10 to cover the drain electrode DE, the source electrode SE, and the data lines $DL_q$, $DL_{q+1}$, and $DL_{q+2}$. The protective layer 12 may be omitted in an alternative embodiment.

The planarization layer 13 includes an organic material such as, for example, an acrylic resin. A pixel electrode PE is disposed on the planarization layer 13. The pixel electrode PE is connected to the drain electrode DE through a contact hole TH1.

A color filter CF including a black matrix BM and a common electrode CE are disposed on a second substrate 20 facing the first substrate 10. A liquid crystal layer 30 is disposed between the first substrate 10 and the second substrate 20.

The color filter CF shown in FIG. 2C is disposed to correspond to each of the sub-pixels SPX shown in FIG. 1. Although not shown in FIG. 2C, the color filter CF and the common electrode CE may be disposed on the first substrate 10.

The display panel DP should not be limited to the liquid crystal display panel. That is, the display panel DP may be, but not limited to, an organic light emitting display panel, an electrophoretic display panel, or an electro-wetting display panel.

In addition, in the description herein, the sub-pixel SPX being connected to a corresponding data line and a corresponding gate line means the switching device SW of the sub-pixel SPX being connected to the corresponding data line and the corresponding gate line.

Hereinafter, the signal controller 100, the gate driver 200, the data driver 300, the first selector 400, and the second selector 500 will be described with reference now to FIG. 1.

The signal controller 100 receives image signals R, G, and B and control signals from an external graphic controller (not shown). The control signals include a vertical synchronization signal $V_{sync}$, a horizontal synchronization signal $H_{sync}$, a main clock signal MCLK, and a data enable signal SDE. The signal controller 100 processes the image signals R, G, and B and the control signals in consideration of operation conditions of the display panel DP and generates the processed image data R', G', and B', a gate control signal CONT1, and a data control signal CONT2. In addition, the signal controller 100 outputs a first selector control signal CS4 and a second selector control signal CS5 which control the first selector 400 and the second selector 500, respectively.

The gate control signal CONT1 is applied to the gate driver 200. The gate control signal CONT1 includes a vertical synchronization start signal indicating a start of each frame, a gate clock signal controlling an output timing of the gate signal, and an output enable signal determining a pulse width of the gate signal. Also, the gate driver 200 is provided with a reference voltage VSS.

The data control signal CONT2 is applied to the data driver 300. The data control signal CONT2 includes a horizontal synchronization start signal indicating an input timing of the image data R', G', and B', an inversion signal inverting a polarity of the data signal with respect to the common voltage, and a data clock signal.

The first selector control signal CS4 and the second selector control signal CS5 control the data signals to be applied to the data lines DL-1G and DL-2G.

The gate driver 200 applies the gate signals, each having a gate-on period and a gate-off period, to the gate lines $GL_1$ to $GL_n$ in response to the gate control signal CONT1.

The gate driver 200 includes a plurality of shift registers (not shown) connected to one another. The shift register may be directly formed on the first substrate 10 (refer to FIG. 2B) when the switching device SW is formed. In other words, the gate driver 200 may be directly formed on the first substrate 10 through a thin film process without mounting a separate gate driving chip on the first substrate 10.

The data driver 300 is connected to the data lines DL-1G and DL-2G through the first selector 400 and the second selector 500 and converts a reference power source voltage GVDD into the data signals corresponding to the image data R', G', B.

The first selector 400 and the second selector 500 receive the first selector control signal CS4 and the second selector control signal CS5 from the signal controller 100, respectively. In an alternative embodiment, the first selector 400 and the second selector 500 may be included in the data driver 300. Also, as shown in FIG. 1, in an exemplary embodiment, a plurality of first selectors 400 and a plurality of second selectors 500 may be provided.

The first selector 400 receives first data signals DVodd from the data driver 300 and the second selector 500 receives second data signals DVeven from the data driver 300. The first data signals DVodd have a polarity different from that of the second data signals DVeven. The first selector 400 and the second selector 500 apply the first and second data signals DVodd and DVeven to different data lines.

Figure 3:
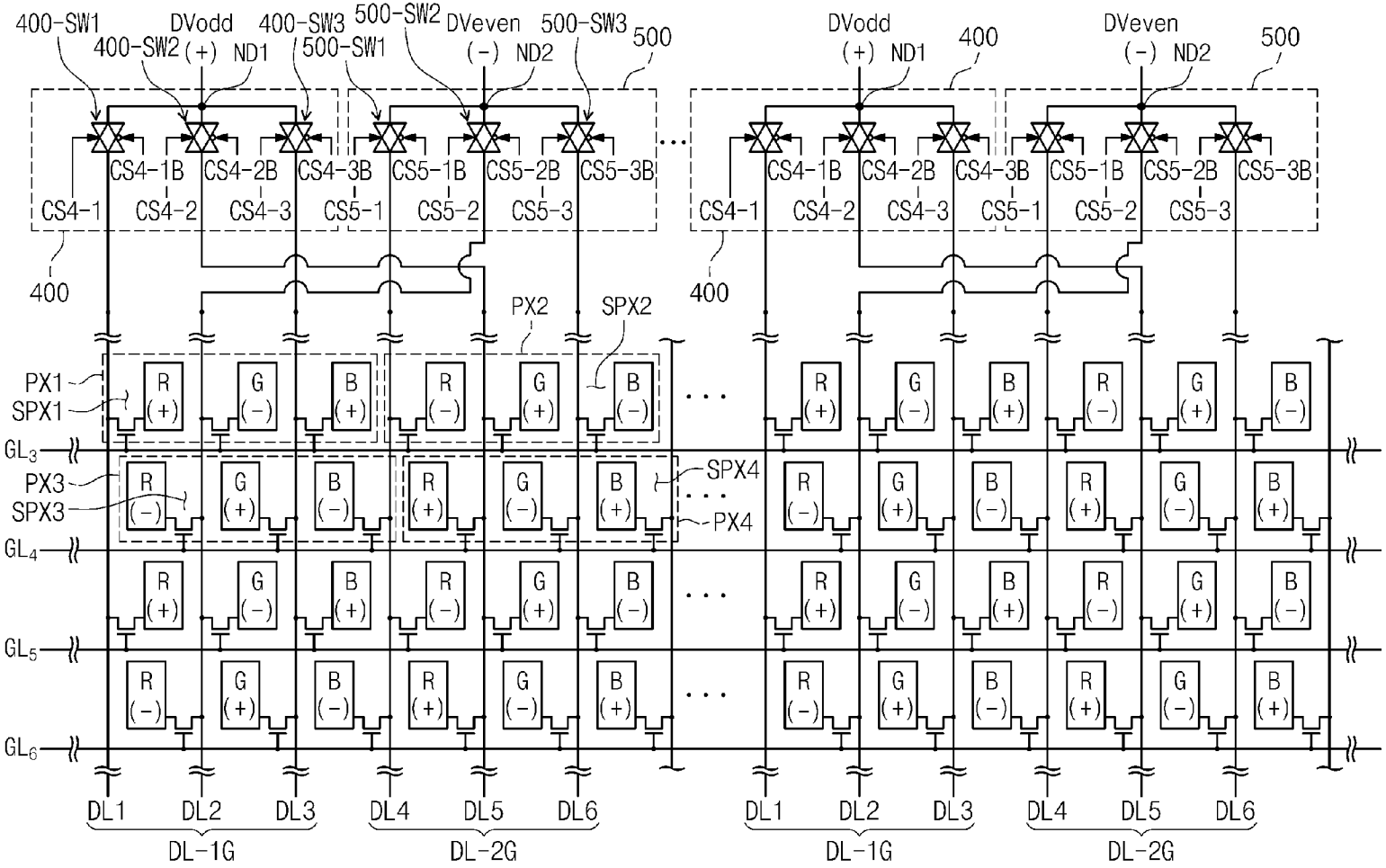
FIG. 3 is an enlarged plan view showing a portion of a display panel shown in FIG. 1.
Figure 4:
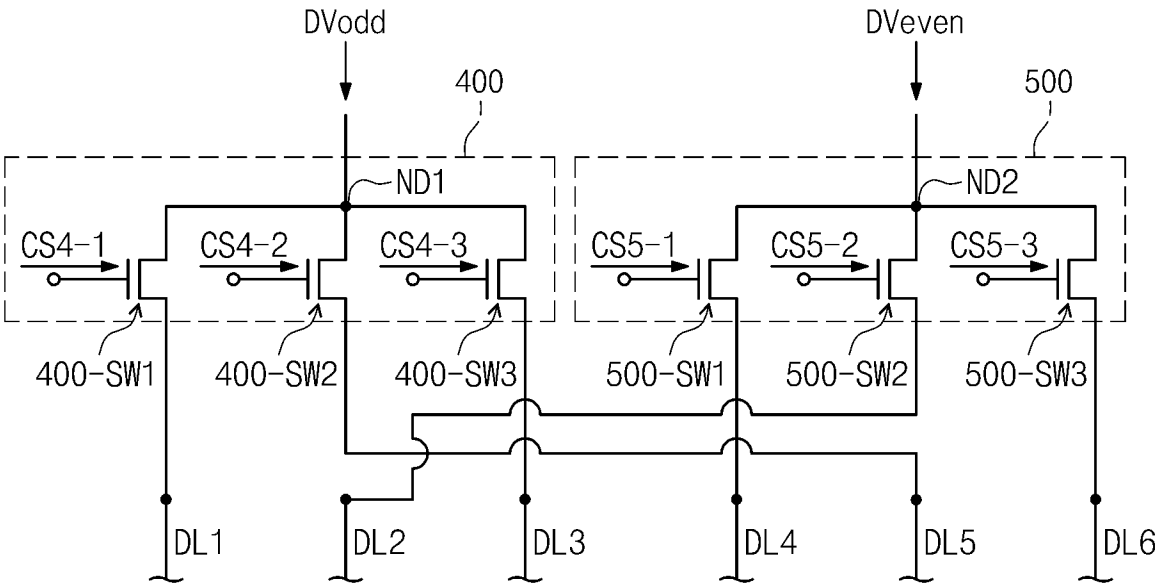
FIG. 4 is a circuit diagram showing another exemplary embodiment of a first selector and a second selector shown in FIG. 3 according to the invention.

FIG. 3 is an enlarged plan view showing a portion of a display panel shown in FIG. 1 and FIG. 4 is a circuit diagram showing another exemplary embodiment of a first selector and a second selector shown in FIG. 3 according to the invention. FIG. 3 shows four gate lines $GL_3$, $GL_4$, $GL_5$, and $GL_6$ of the gate lines $GL_1$ to $GL_n$ as an example.

Hereinafter, a connection relation between the data lines DL-1G and DL-2G and the sub-pixels SPX and a connection relation between the data lines DL-1G and DL-2G and the first selector 400 and the second selector 500 will be described in detail.

The data lines DL-1G and DL-2G includes a plurality of first data line groups DL-1G and a plurality of second data line groups DL-2G. In an exemplary embodiment, the first data line group DL-1G and the second data line group DL-2G are alternately arranged with each other. Each of the first and second data line groups DL-1G and DL-2G includes i (i is a natural number larger than 2) consecutive data lines.

As shown in FIG. 3, each of the first and second data line groups DL-1G and DL-2G includes three consecutive data lines. That is, the first data line group DL-1G includes first, second, and third data lines DL1, DL2, and DL3 that are consecutive to one another, and the second data line group DL-2G includes fourth, fifth, and sixth data lines DL4, DL5, and DL6 that are consecutive to one another.

The sub-pixels SPX (refer to FIG. 1) are divided into two or more sub-pixel groups according to the connection relation between the gate lines $GL_1$ to $GL_n$ and the data lines DL-1G and DL-2G. In an exemplary embodiment, the sub-pixels SPX are classified into at least first sub-pixels SPX1 and second sub-pixels SPX2.

The first sub-pixels SPX1 are connected to one of the gate lines $GL_1$ to $GL_n$, e.g., the third gate line $GL_3$ in the exemplary embodiment of FIG. 3, and connected to one of the first, second, and third data lines DL1, DL2, and DL3 included in the first data line group DL-1G. As shown in FIG. 3, a group of the first sub-pixels SPX1 may be defined as a first pixel PX1. The number of the first sub-pixels SPX1 included in the first pixel PX1 corresponds to the number of the data lines included in the first data line group DL-1G.

The second sub-pixels SPX2 are connected to the third gate line $GL_3$ and respectively connected to the fourth, fifth, and sixth data lines DL4, DL5, and DL6 included in the second data line group DL-2G. As shown in FIG. 3, a group of the second sub-pixels SPX2 may be defined as a second pixel PX2.

In an exemplary embodiment, the sub-pixels SPX (refer to FIG. 1) may be further classified into third sub-pixels SPX3 and fourth sub-pixels SPX4. The connection relation of the third and fourth sub-pixels SPX3 and SPX4 with respect to the gate lines $GL_3$ to $GL_6$ and the data lines DL-1G and DL-2G is different from the connection relation of the first and second sub-pixels SPX1 and SPX2 with respect to the gate lines $GL_3$ to $GL_6$ and the data lines DL-1G and DL-2G.

The third sub-pixels SPX3 are connected to one of the gate lines $GL_1$ to $GL_n$ other than the gate line to which the first and second sub-pixels SPX1 and SPX2 are connected. In the exemplary embodiment of FIG. 3, the third sub-pixels SPX3 are connected to the fourth gate line $GL_4$ which is adjacent to the third gate line $GL_3$ to which the first and second sub-pixels SPX1 and SPX2 are connected.

Each of the third sub-pixels SPX3 are connected to second to i-th data lines of the first data line group DL-1G and a first data line of the second data line group DL-2G, respectively.

In detail, as shown in FIG. 3, three of the third sub-pixels SPX3 are respectively connected to the second and third data lines DL2 and DL3 of the first data line group DL-1G and the first data line DL4 of the second data line group DL-2G. A group of the third sub-pixels SPX3 may be defined as a third pixel PX3.

The fourth sub-pixels SPX4 are connected to the gate line $GL_4$. The fourth sub-pixels SPX4 are connected to second to i-th data lines of the second data line group DL-2G and the first data line of the first data line group DL-1G.

In detail, as shown in FIG. 3, three of the fourth sub-pixels SPX4 are respectively connected to the second and third data lines DL5 and DL6 of the second data line group DL-2G and the first data line DL1 of the first data line group DL-1G. A group of the fourth sub-pixels SPX4 may be defined as a fourth pixel PX4.

Each of three first sub-pixels SPX1 included in the first pixel PX1 displays one of red R, green G, and blue B. The three first sub-pixels SPX1 included in the first pixel PX1 include the color filters CF (refer to FIG. 2C) for the red R, green G, and blue B, respectively. Similarly, the three sub-pixels SPX2, SPX3, and SPX4 included in each of the second, third, and fourth pixels PX2, PX3, and PX4 display the red R, green G, and blue B, respectively.

The first selector 400 is connected to odd-numbered data lines of the data lines DL-1G and DL-2G and the second selector 500 is connected to even-numbered data lines of the data lines DL-1G and DL-2G.

As shown in FIG. 3, one of the plurality of the first selectors 400 is connected to the first data line DL1 and the third data line DL3 of the first data line group DL-1G and the second data line DL5 of the second data line group DL-2G. The first selector 400 selectively applies the first data signals DVodd to the odd-numbered data lines DL1, DL3, and DL5 in response to the first selector control signal CS4.

The first selector 400 includes a plurality of first switching devices 400-SW1, 400-SW2, and 400-SW3. The number of the first switching devices 400-SW1, 400-SW2, and 400-SW3 corresponds to the number of the data lines DL1, DL2 and DL3 connected to the first selector 400.

Input terminals of the first switching devices 400-SW1, 400-SW2, and 400-SW3 are connected to a first input node ND1 to which the first data signals DVodd are applied. Output terminals of the first switching devices 400-SW1, 400-SW2, and 400-SW3 are respectively connected to different data lines among the odd-numbered data lines DL1, DL3, and DL5.

Control terminals of the first switching devices 400-SW1, 400-SW2, and 400-SW3 receive the first selector control signal CS4 (refer to FIG. 1). The first selector control signal CS4 includes pairs of non-inverting/inverting switching signals CS4-1/CS4-1B, CS4-2/CS4-2B, and CS4-3/CS4-3B. The first switching devices 400-SW1, 400-SW2, and 400-SW3 are turned on in response to the non-inverting/inverting switching signals CS4-1/CS4-1B, CS4-2/CS4-2B, and CS4-3/CS4-3B, respectively.

Referring to FIG. 3, each of the first switching devices 400-SW1, 400-SW2, and 400-SW3 may be a transmission gate including two control terminals. Each of the first switching devices 400-SW1, 400-SW2, and 400-SW3, each of which includes the two control terminals, may be a complementary metal-oxide semiconductor ("CMOS") transistor in which an N-channel transistor and a P-channel transistor are connected to each other in parallel. Each of the N-channel transistor and the P-channel transistor includes a control terminal.

The switching signals CS4-1, CS4-2, and CS4-3 applied to the control terminal of the N-channel transistor of the first switching device 400-SW1, 400-SW2, and 400-SW3 are opposite in phase to the switching signals CS4-1B, CS4-2B, and CS4-3B applied to the control terminal of the P-channel transistor of the first switching device 400-SW1, 400-SW2, and 400-SW3. The first switching devices 400-SW1, 400-SW2, and 400-SW3, each having the N-channel transistor and the P-channel transistor connected to each other in parallel, have a fast response speed because there is no threshold voltage drop in the first switching devices 400-SW1, 400-SW2, and 400-SW3.

As shown in FIG. 3, the second selector 500 selectively applies the second data signals DVeven to the even-numbered data lines DL2, DL4, and DL6 in response to the second selector control signal CS5. The second selector 500 includes a plurality of second switching devices 500-SW1, 500-SW2, and 500-SW3.

The second switching devices 500-SW1, 500-SW2, and 500-SW3 may have the same configurations as those of the first switching devices 400-SW1, 400-SW2, and 400-SW3.

Specifically, input terminals of the second switching devices 500-SW1, 500-SW2, and 500-SW3 are connected to a second input node ND2 to which the second data signals DVeven are applied. Output terminals of the second switching devices 500-SW1, 500-SW2, and 500-SW3 are connected to different data lines from one another among the even-numbered data lines DL2, DL4, and DL6.

The second selector control signal CS5 includes pairs of non-inverting/inverting switching signals CS5-1/CS5-1B, CS5-2/CS5-2B, and CS5-3/CS5-3B.

In an alternative embodiment, as shown in FIG. 4, each of the first switching devices 400-SW1, 400-SW2, and 400-SW3 and each of the second switching devices 500-SW1, 500-SW2, and 500-SW3 may be a thin film transistor including one control terminal. The first switching devices 400-SW1, 400-SW2, and 400-SW3 are turned on in response to the switching signals CS4-1, CS4-2, and CS4-3 applied to gate electrodes thereof, respectively, and the second switching devices 500-SW1, 500-SW2, and 500-SW3 are turned on in response to the switching signals CS5-1, CS5-2, and CS5-3 applied to gate electrodes thereof, respectively.

Figure 5:
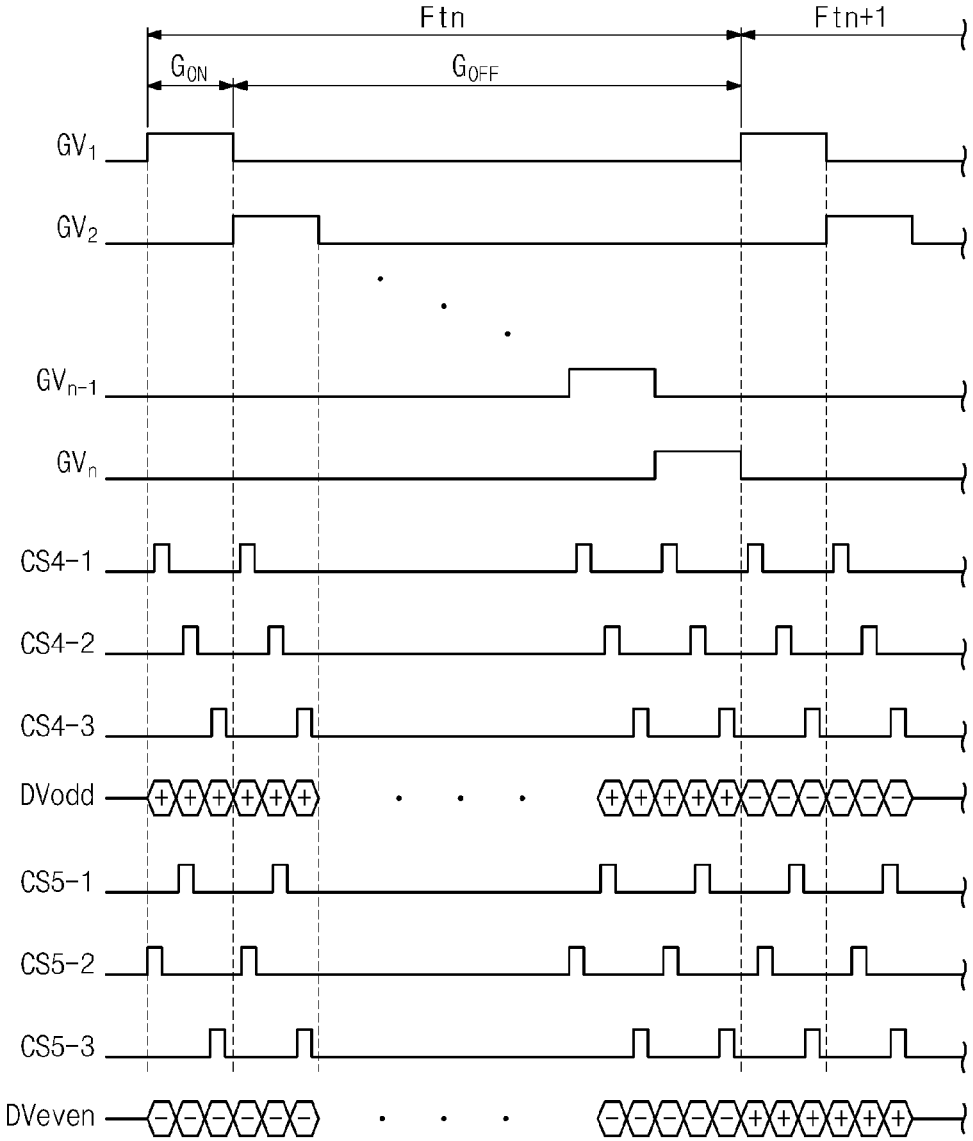
FIG. 5 is a timing diagram showing an exemplary embodiment of an operation of a display apparatus shown in FIG. 1.

FIG. 5 is a timing diagram showing an exemplary embodiment of an operation of a display apparatus shown in FIG. 1. Hereinafter, a method of driving the display apparatus according to an exemplary embodiment will be described in detail with reference to FIG. 5. In FIG. 5, the inverting switching signals CS4-1B, CS4-2B, and CS4-3B of the first selector control signal CS4 and the inverting switching signals CS5-1B, CS5-2B, and CS5-3B of the second selector control signal CS5 are omitted for purpose of clarity. It should be noted that the inverting switching signals of the first selector control signal CS4 and the second selector control signal CS5 are activated at the same time as the non-inverting switching signals.

The display apparatus displays the image during a plurality of frame periods. The image displayed in a present frame period Ftn may be different from the image displayed in a subsequent frame period Ftn+1.

The gate driver 200 applies the gate signals $GV_1$ to $GV_n$ to the gate lines $GL_1$ to $GL_n$ during the frame periods Ftn and Ftn+1, respectively. The gate signals $GV_1$ to $GV_n$ shown in FIG. 5 have a one-to-one correspondence with the gate lines $GL_1$ to $GL_n$. Each of the gate signals $GV_1$ to $GV_n$ is activated during at least a portion of the frame periods Ftn and Ftn+1.

Among the frame periods Ftn and Ftn+1, a period during which each of the gate signals $GV_1$ to $GV_n$ is activated is defined as a gate-on period $G_{ON}$ and a remaining period during a corresponding frame period is defined as a gate-off period $G_{OFF}$. Gate-on periods $G_{ON}$ of the gate signals $GV_1$ to $GV_n$ corresponding to the gate lines $GL_1$ to $GL_n$ occur at different times.

The data driver 300 (refer to FIG. 1) applies the first data signals DVodd and the second data signals DVeven to the first selector 400 and the second selector 500, respectively, during the each gate-on period $G_{ON}$ of the gate lines $GL_1$ to $GL_n$.

The polarity of the first data signals DVodd and the polarity of the second data signals DVeven may be inverted every frame period including Ftn and Ftn+1. As shown in FIG. 5, in an exemplary embodiment, the first data signals DVodd have a positive (+) polarity during the present frame period Ftn and have a negative (−) polarity during the next frame period Ftn+1, and the second data signals DVeven have the negative (−) polarity during the present frame period Ftn and have the positive (+) polarity during the next frame period Ftn+1.

The first switching devices 400-SW1, 400-SW2, and 400-SW3 of the first selector 400 are turned on corresponding to activation of the switching signals CS4-1, CS4-2, and CS4-3 from the signal controller 100. Since activation periods of the switching signals CS4-1, CS4-2, and CS4-3 are different from one another, the first switching devices 400-SW1, 400-SW2, and 400-SW3 of the first selector 400 are turned on at different times.

As shown in FIG. 5, the first switching devices 400-SW1, 400-SW2, and 400-SW3 are sequentially turned on during an activation period of each of the gate signals $GV_1$ to $GV_n$. The first selector 400 applies the first data signals DVodd to the data lines through the turned-on first switching devices 400-SW1, 400-SW2, and 400-SW3, respectively.

The first data signals DVodd are applied to the odd-numbered data lines DL1, DL3, and DL5 (refer to FIG. 3) according to an order in which the first switching devices 400-SW1, 400-SW2, and 400-SW3 of the first selector 400 are turned on.

The second selector 500 applies the second data signals DVeven to the even-numbered data lines DL2, DL4, and DL6 (refer to FIG. 3), respectively, in the same manner as the first selector 400.

As shown in FIG. 5, a turn-on order of the second switching devices 500-SW1, 500-SW2, and 500-SW3 may be different from a turn-on order of the first switching devices 400-SW1, 400-SW2, and 400-SW3.

Referring to FIGS. 3 and 5, when the first data signals DVodd with the positive (+) polarity are applied to the odd-numbered data lines DL1, DL3, and DL5 and the second data signals DVeven with the negative (−) polarity are applied to the even-numbered data lines DL2, DL4, and DL6 in the present frame period Ftn, each polarity of the data signals applied to the first to fourth sub-pixels SPX1, SPX2, SPX3, and SPX4 is dot-inverted. That is, the polarities of the data signals applied to the sub-pixels SPX1, SPX2, SPX3, and SPX4 are different between adjacent sub-pixels.

As described above, since the polarities of the data signals applied to the adjacent sub-pixels SPX1, SPX2, SPX3, and SPX4 are different between adjacent sub-pixels, flicker is reduced and display quality is improved. In addition, power consumption is reduced since a dot-inversion image display scheme is achieved by using the column-inversion driving method in which the data voltages applied to the data lines are inverted every data line.

Figure 6:
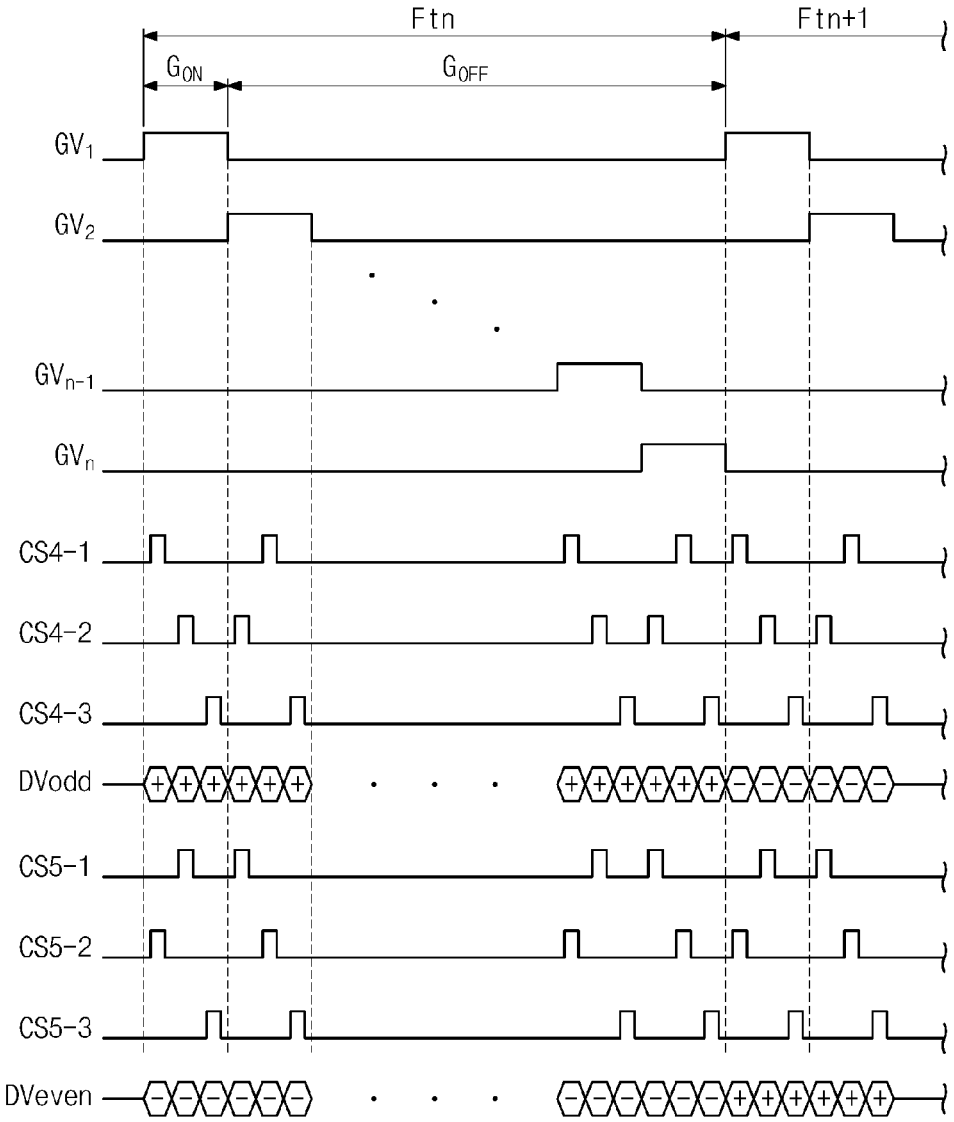
FIG. 6 is a timing diagram showing another exemplary embodiment of an operation of a display apparatus according to the invention.

FIG. 6 is a timing diagram showing another exemplary embodiment of an operation of a display apparatus according to the invention. Hereinafter, a method of driving a display apparatus will be described in detail according to another exemplary embodiment of the invention.

The turn-on order of the first switching devices 400-SW1, 400-SW2, and 400-SW3 and the turn-on order of the second switching devices 500-SW1, 500-SW2, and 500-SW3 may be different for each of the gate signals $GV_1$ to $GV_n$.

The gate lines $GL_1$ to $GL_n$ (refer to FIG. 1) may be divided into odd-numbered gate lines $GL_1$, $GL_3$, . . . , $GL_{n-1}$ and even-numbered gate lines $GL_2$, $GL_4$, . . . , $GL_n$, n being an even number. The first switching devices 400-SW1, 400-SW2, and 400-SW3 are sequentially turned on when odd-numbered gate signals $GV_1$, $GV_3$ (not shown), . . . , $GV_{n-1}$ are applied to the odd-numbered gate lines $GL_1$, $GL_3$, . . . , $GL_{n-1}$, respectively.

On the other hand, when even-numbered gate signals $GV_2$, $GV_4$ (not shown), . . . , $GV_n$ are applied to the even-numbered gate lines $GL_2$, $GL_4$, . . . , $GL_n$, respectively, the turn-on order of the first switching devices 400-SW1, 400-SW2, and 400-SW3 is changed. As shown in FIG. 6, the first switching devices 400-SW1, 400-SW2, and 400-SW3 may be turned on in an order of the second, first, and third first-switching devices 400-SW2, 400-SW1, and 400-SW3.

The turn-on order of the second switching devices 500-SW1, 500-SW2, and 500-SW3 when the odd-numbered gate signals $GV_1$, $GV_3$ (not shown), . . . , $GV_{n-1}$ are respectively applied to the odd-numbered gate lines $GL_1$, $GL_3$, . . . , $GL_{n-1}$ may correspond to the turn-on order of the first switching devices 400-SW1, 400-SW2, and 400-SW3 when the even-numbered gate signals $GV_2$, $GV_4$ (not shown), . . . , $GV_n$ are respectively applied to the even-numbered gate lines $GL_2$, $GL_4$, . . . , $GL_n$.

In addition, the turn-on order of the second switching devices 500-SW1, 500-SW2, and 500-SW3 when the even-numbered gate signals $GV_2$, $GV_4$ (not shown), . . . , $GV_n$ are respectively applied to the even-numbered gate lines $GL_2$, $GL_4$, $GL_n$ may correspond to the turn-on order of the first switching devices 400-SW1, 400-SW2, and 400-SW3 when the odd-numbered gate signals $GV_1$, $GV_3$ (not shown), . . . , $GV_{n-1}$ are respectively applied to the odd-numbered gate lines $GL_1$, $GL_3$, . . . , $GL_{n-1}$.

As described above, since the turn-on order of the first switching devices 400-SW1, 400-SW2, and 400-SW3 and the turn-on order of the second switching devices 500-SW1, 500-SW2, and 500-SW3 are changed according to the gate signals $GV_1$ to $G_n$, the turn-on order of the first, second, third, and fourth pixels PX1, PX2, PX3, and PX4 may be changed for each gate line.

Figure 7:
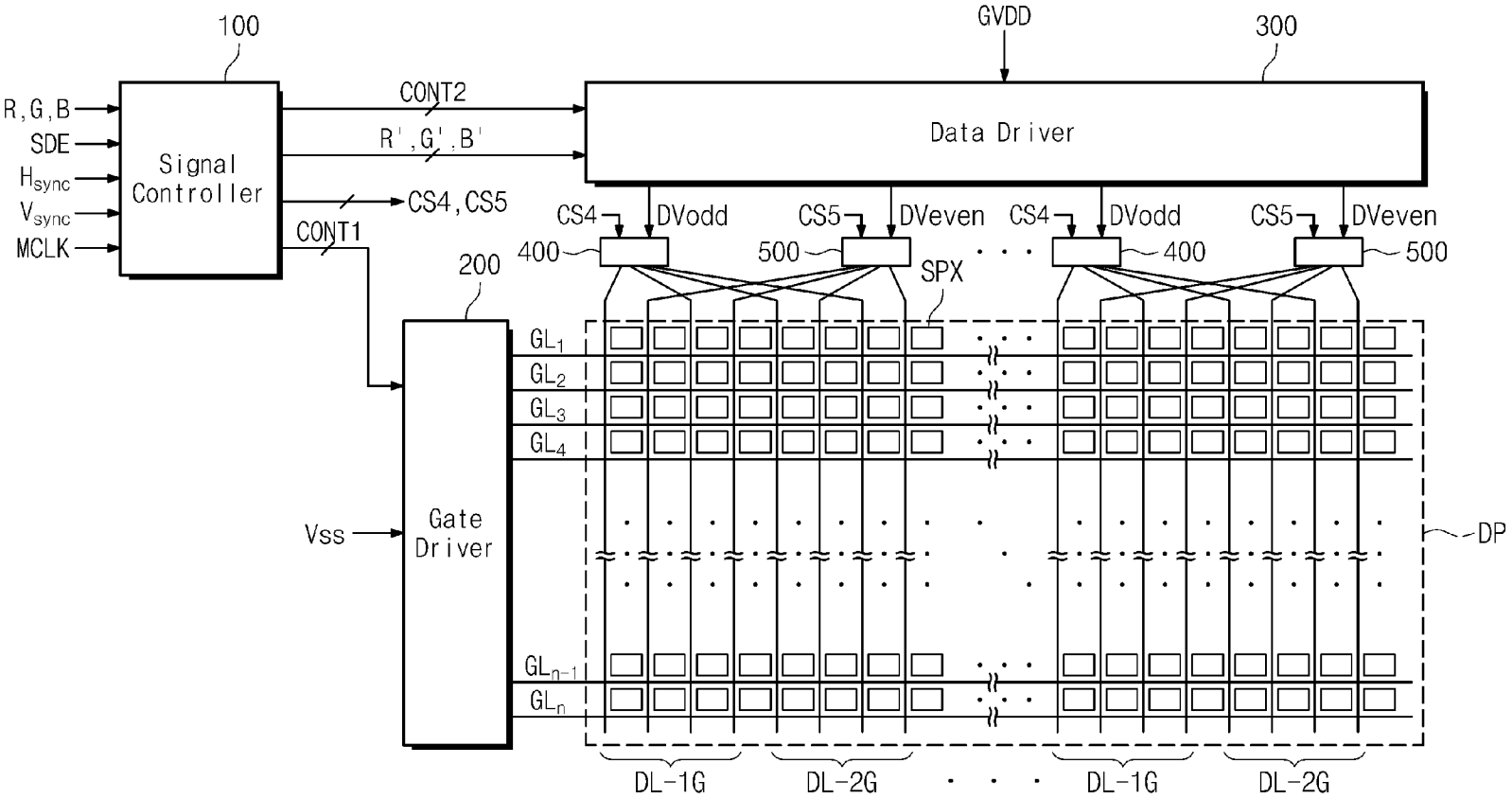
FIG. 7 is a block diagram showing another exemplary embodiment of a display apparatus according to the invention.
Figure 8:
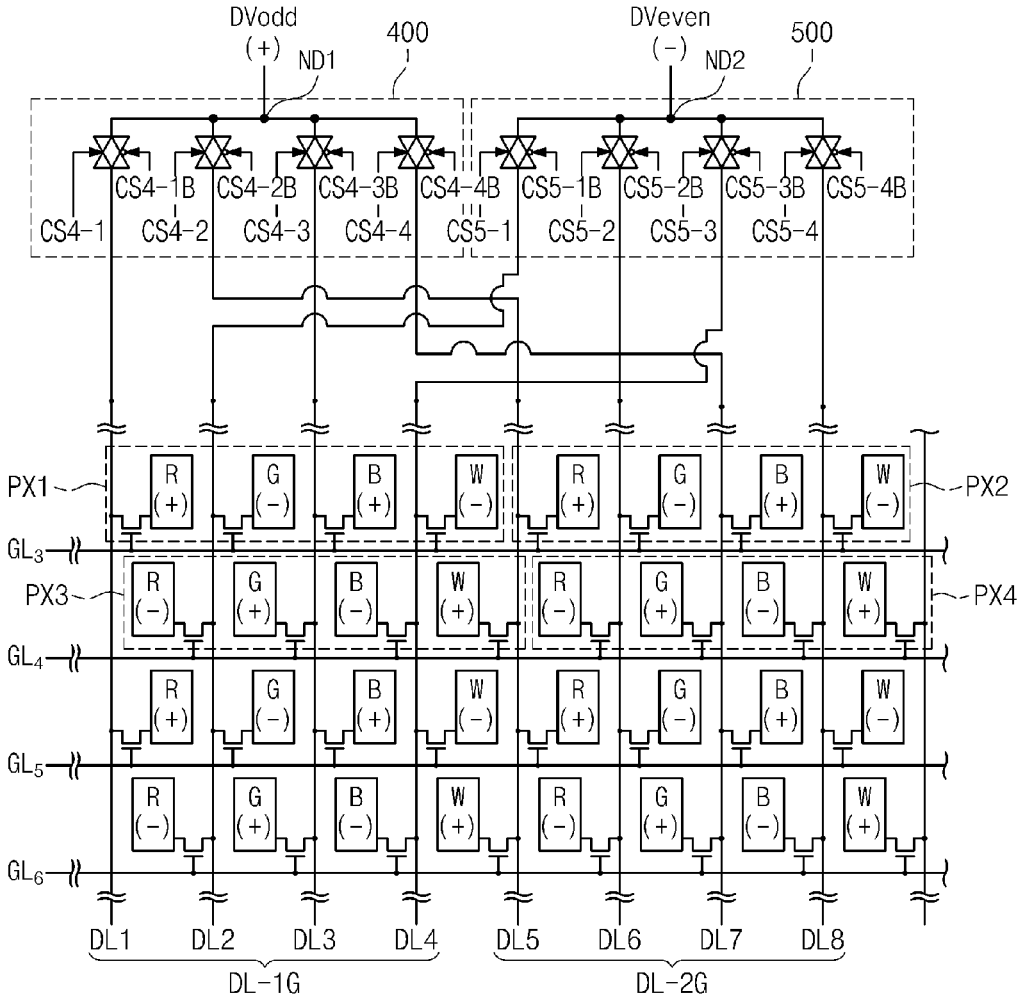
FIG. 8 is an enlarged plan view showing a portion of a display apparatus shown in FIG. 7.

FIG. 7 is a block diagram showing another exemplary embodiment of a display apparatus according to the invention and FIG. 8 is an enlarged plan view showing a portion of a display apparatus shown in FIG. 7. In FIGS. 7 and 8, the same reference numerals denote the same elements in FIGS. 1 to 6, and thus detailed descriptions of the same elements will be omitted.

Referring to FIGS. 7 and 8, each of the first, second, third, and fourth pixels PX1, PX2, PX3, and PX4 includes four sub-pixels. In an exemplary embodiment, the first, second, third, and fourth pixels PX1, PX2, PX3, and PX4 have the same configuration and function, and thus the first pixel PX1 will be described as a representative example.

Four first sub-pixels SPX1 included in the first pixel PX1 display different colors from one another. In an exemplary embodiment, three of the four first sub-pixels SPX1 may display the red R, green G, and blue B, respectively, and the remaining one of the four first sub-pixels SPX1 may display white W. In this case, brightness of the display apparatus may be improved.

Each of the four first sub-pixels SPX1 includes the color filter CF (refer to FIG. 2C) corresponding to the color displayed thereon. The first sub-pixel SPX1 displaying the white W includes a transparent color filter.

Each of the first data line groups DL-1G and the second data line groups DL-2G, which are alternately arranged with each other, includes four consecutive data lines. That is, in the exemplary embodiment of FIG. 7, the first data line group DL-1G includes first, second, third, and fourth data lines DL1, DL2, DL3, and DL4 that are consecutive to one another, and the second data line group DL-2G includes fifth, sixth, seventh, and eighth data lines DL5, DL6, DL7, and DL8 that are consecutive to one another.

The four first sub-pixels SPX1 are connected to the first, second, third, and fourth data lines DL1, DL2, DL3, and DL4 included in the first data line group DL-1G, respectively, and four second sub-pixels SPX2 are connected to the fifth, sixth, seventh, and eighth data lines DL5, DL6, DL7, and DL8 included in the second data line group DL-2G, respectively.

Four third sub-pixels SPX3 are connected to the second, third, and fourth data lines DL2, DL3, and DL4 of the first data line group DL-1G and the fifth data line DL5 of the second data line group DL-2G, respectively.

Four fourth sub-pixels SPX4 are connected to the sixth, seventh, and eighth data lines DL6, DL7, and DL8 of the second data line group DL-2G and the first data line DL1 of the first data line group DL-1G disposed adjacent to the eighth data line DL8 of the second data line group DL-2G, respectively.

The first selector 400 includes four first switching devices 400-SW1, 400-SW2, 400-SW3, and 400-SW4 and the second selector 500 includes four second switching devices 500-SW1, 500-SW2, 500-SW3, and 500-SW4.

Output terminals of the four first switching devices 400-SW1, 400-SW2, 400-SW3, and 400-SW4 are connected to odd-numbered data lines DL1, DL3, DL5, and DL7, and output terminals of the four second switching devices 500-SW1, 500-SW2, 500-SW3, and 500-SW4 are connected to even-numbered data lines DL2, DL4, DL6, and DL8, respectively.

As described above, the display apparatus may improve the display quality and reduce the power consumption. In addition, since the number of the first and second selectors 400 and 500 is reduced compared to the exemplary embodiment of FIG. 1, circuit configuration of the display apparatus may be simplified.

Thus, according to the invention, the data signals applied to the sub-pixels have polarity patterns of a dot inversion. Accordingly, the display apparatus displays an image in a dot inversion scheme by using a column inversion driving method. Therefore, power consumption of the display apparatus may be reduced and image display quality of the display apparatus may be improved.

In addition, each of the first and second selectors applies the data signals to a plurality of the data lines. Therefore, a circuit configuration of the display apparatus may be simplified.

The first selector, which applies the data signals to the first data line group during a gate-on period corresponding to each gate line, may change an order of applying the data signals to the first data line group for every gate line. In other words, the turn-on order of the first switching devices of the first selector may be changed. Thus, a difference in charge rate between the first sub-pixels connected to first selector may be reduced. It should be noted that the same applies in a case of the second selector.

Although the exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A display apparatus comprising:

a first data line group which includes at least three first data lines consecutively arranged in a first direction, each of the first data lines is extended in a second direction crossing the first direction;

a second data line group which is adjacent to the first data line group and includes at least three second data lines consecutively arranged in the first direction, each of the second data lines is extended in the second direction;

a plurality of gate lines which is extended in the first direction;

a first pixel which includes at least three first sub-pixels connected to a first gate line of the plurality of the gate lines and respectively connected to corresponding data lines included in the first data line group;

a second pixel which includes at least three second sub-pixels connected to a second gate line, one of the at least three second sub-pixels is connected to a corresponding data line included in the second data line group and other second sub-pixels of the at least three second sub-pixels are connected to corresponding data lines included in the first data line group;

a first selector having at least three first switching devices, all of the at least three first switching devices applying first data signals to odd-numbered data lines included in the first and second data line groups in response to a first control signal;

a second selector having at least three second switching devices, all of the at least three second switching devices applying second data signals to even-numbered data lines included in the first and second data line groups in response to a second control signal, the first data signals including a different polarity from the second data signals; and a data driver which applies the first data signals to the first selector and applies the second data signals to the second selector, wherein the first pixel and the second pixel are arranged in the second direction.

2. The display apparatus of claim 1, wherein each of the first data line group and the second data line group comprises consecutive first to i-th data lines, and the first data line group and the second data line group alternate with each other, and the i is a natural number larger than 2, and the at least three first sub-pixels of the first pixel are connected to first to i-th data lines of the first data line group, and the at least three second sub-pixels of the second pixel are connected to second to i-th data lines of the first data line group and to a first data line of the second data line group, the second data line group adjacent to the first data line group.

3. The display apparatus of claim 1, wherein each of the at least three first switching devices comprises an input terminal connected to a first input node to which the first data signals are applied, an output terminal connected to a corresponding data line included in the first and second data line groups, and a control terminal which receives the first control signal.

4. The display apparatus of claim 3, wherein the first control signal comprises a plurality of switching signals activated in different activation periods from each other, and the at least three first switching devices are turned on in response to corresponding activation periods of the switching signals, respectively.

5. The display apparatus of claim 4, wherein the at least three first switching devices sequentially apply the first data signals to the odd-numbered data lines in accordance with a turn-on order of the at least three first switching devices.

6. The display apparatus of claim 3, wherein each of the at least three second switching devices comprises an input terminal connected to a second input node to which the second data signals are applied, an output terminal connected to a corresponding data line included in the first and second data line groups, and a control terminal which receives the second control signal.

7. The display apparatus of claim 6, further comprising:

a gate driver which sequentially applies gate signals to the plurality of the gate lines.

8. The display apparatus of claim 7, wherein the data driver applies the first data signals having a first polarity to the first selector and applies the second data signals having a second polarity to the second selector during a first frame period, and the data driver applies the first data signals having the second polarity to the first selector and applies the second data signals having the first polarity to the second selector during a second frame period, the second frame period following the first frame period, the first polarity and the second polarity being different from each other.

9. The display apparatus of claim 1, wherein the at least three first pixel comprises three first sub-pixels, which respectively display red, green, and blue colors, and the at least three second pixel comprises three second sub-pixels, which respectively display the red, green, and blue colors.

10. The display apparatus of claim 9, wherein each of the three first sub-pixels comprises a color filter corresponding to a color displayed thereon and each of the three second sub-pixels comprises a color filter corresponding to a color displayed thereon.

11. The display apparatus of claim 9, wherein the first pixel further comprises a first sub-pixel which displays a white color, and the second pixel further comprises a second sub-pixel which displays a white color.

12. A display apparatus comprising:

a plurality of data lines divided into a first data line group, and a second data line group alternate with the first data line group, each of the first and second data line groups comprising first to i-th consecutive data lines, wherein i is a natural number larger than 3;

a first gate line and a second gate line, which alternate with each other;

a first pixel which includes an i number of first sub-pixels connected to the first gate line and respectively connected to the i number of data lines of the first data line group;

a second pixel which includes an i number of second sub-pixels connected to the second gate line and respectively connected to second to i-th data lines of the first data line group and a first data line of the second data line group;

first selectors having an i number of first switching devices, all of the i number of first switching devices selectively applying first data signals to odd-numbered data lines of the plurality of the data lines in accordance with a first control signal;

second selectors having an i number of second switching devices, all of the i number of second switching devices selectively applying second data signals to even-numbered data lines of the plurality of the data lines in accordance with a second control signal, the first data signals having a different polarity from the second data signals; and a data driver which applies the first data signals to the first selectors and applies the second data signals to the second selectors, wherein each of the first gate line and the second gate line is extended in a first direction, each of the plurality of data lines is extended in a second direction crossing the first direction, and the first and the second pixels are arranged in the second direction.

13. The display apparatus of claim 12, further comprising:

a gate driver which sequentially applies gate signals to the first and second gate lines; and a signal controller which applies the first control signal to the first selectors and applies the second control signal to the second selectors.

14. The display apparatus of claim 13, wherein the signal controller outputs the first control signal during every gate-on period of the gate signals respectively applied to the first gate line and the second gate line.

15. The display apparatus of claim 14, wherein each of the i number of first switching devices comprises an input terminal connected to a first input node to which the first data signals are applied, an output terminal connected to a corresponding data line of the odd-numbered data lines, and a control terminal which receives the first control signal.

16. The display apparatus of claim 15, wherein the first control signal comprises a plurality of switching signals activated in different activation periods from each other, and the i number of first switching devices are turned on in response to corresponding activation periods of the switching signals, respectively.

17. The display apparatus of claim 16, wherein a turn-on order of the i number of first switching devices which output the first data signals corresponding to a gate-on period of a gate signal applied to the first gate line is different from a turn-on order of the i number of first switching devices which output the second data signals corresponding to a gate-on period of a gate signal applied to the second gate line.

18. The display apparatus of claim 12, wherein the i is three and three sub-pixels of each of the first to fourth sub-pixels display red, green, and blue colors, respectively.

19. The display apparatus of claim 12, wherein the i is four and four sub-pixels of each of the first to fourth sub-pixels display red, green, and blue colors, respectively.

20. The display apparatus of claim 12, further comprising:

a third pixel that includes i third sub-pixels connected to the first gate line and respectively connected to the i data lines of the second data line group; and a fourth pixel that includes i fourth sub-pixels connected to the second gate line and respectively connected to second to i-th data lines of the second data line group and a first data line of the first data line group disposed adjacent to the i-th data line of the second data line group, wherein the first pixel and the third pixel are arranged in the first direction.

21. The display apparatus of claim 4, wherein a turn-on order of the at least three first switching devices which output the first data signals corresponding to a gate-on period of a gate signal applied to the first gate line is different from a turn-on order of the at least three first switching devices which output the second data signals corresponding to a gate-on period of a gate signal applied to the second gate line.

* * * * *